US006457489B2

(12) United States Patent
Smissaert

(10) Patent No.: US 6,457,489 B2
(45) Date of Patent: Oct. 1, 2002

(54) FACE TO FACE PILE WOVEN FABRICS

(75) Inventor: Ludo Smissaert, Assebroek (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/846,231

(22) Filed: May 2, 2001

(30) Foreign Application Priority Data

May 2, 2000 (BE) ..... 2000/0307
Jun. 9, 2000 (BE) ..... 2000/0372

(51) Int. Cl.[7] ..... D03D 27/10
(52) U.S. Cl. ..... 139/21; 139/398
(58) Field of Search ..... 139/21, 398

(56) References Cited

U.S. PATENT DOCUMENTS 5,655,573 A * 8/1997 Gheysen et al. ..... 139/21
6,095,198 A * 8/2000 Debaes ..... 139/21

FOREIGN PATENT DOCUMENTS

EP 628649 12/1994
EP 805227 11/1997
EP 922799 6/1999

* cited by examiner

*Primary Examiner*—Andy Falik
(74) *Attorney, Agent, or Firm*—James Creighton Wray; Meera P. Narasimhan

(57) ABSTRACT

In face-to-face weaving pile fabrics with high pile density, groups of three weft yarns (1–3), (4–6) are inwoven in respective openings between binding warp yarns (7), (8), (9) (10) crossing each other, and non-pile-forming pile warp yarns are inwoven, while pile warp yarns are alternately interlaced in the top and the bottom backing fabric over a weft yarn according to a two-shot weave. In series of four successive weft insertion cycles in each case three weft yarns (1), (2), (3) are inserted for the top backing fabric (30) and three weft yarns (4), (5), (6) for the bottom backing fabric (31). A weaving machine inserts two weft yarns one above the other per weft insertion cycle and by weft disengagement or weft cancellation in the course of two cycles per series inserts only one weft yarn. Two pile-forming pile warp yarns after a pile change are interlaced over a weft yarn.

16 Claims, 5 Drawing Sheets

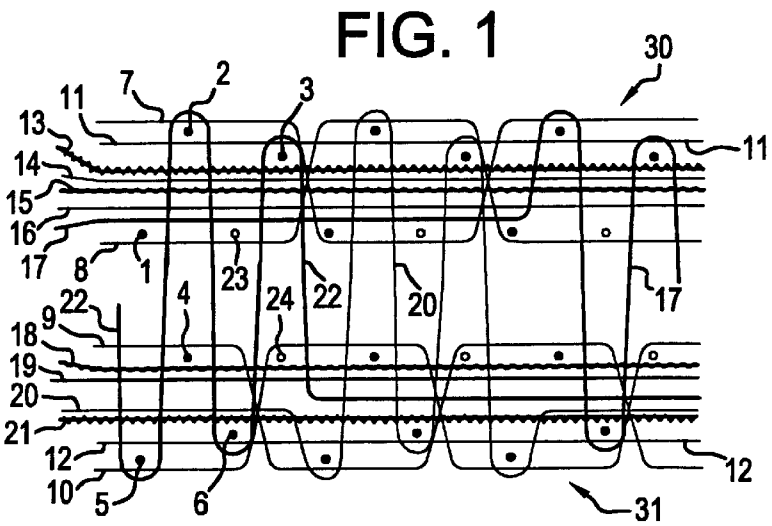
FIG. 1
FIG. 2
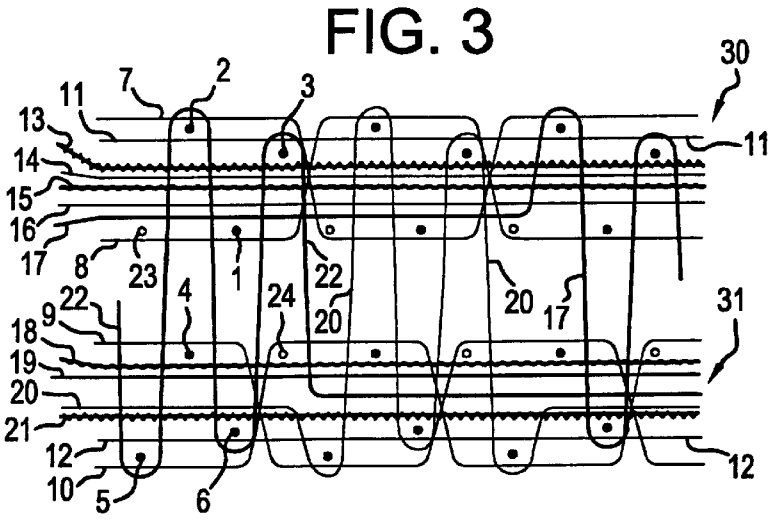
FIG. 3
FIG. 4

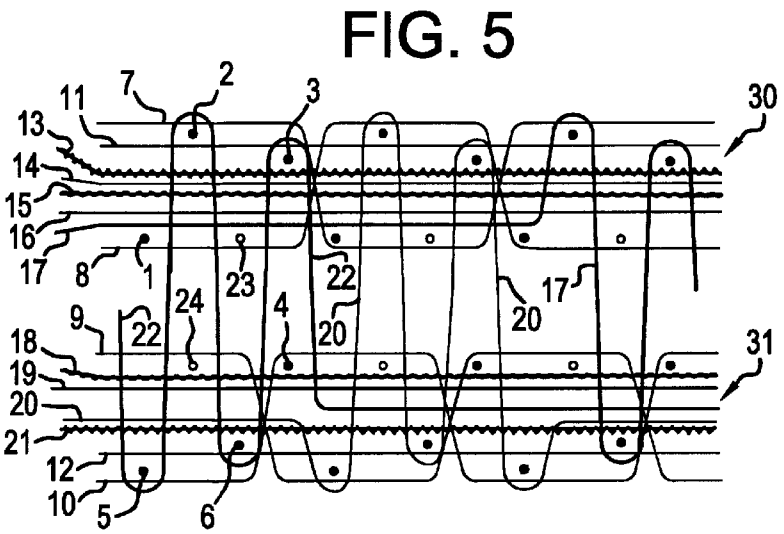
FIG. 5
FIG. 6
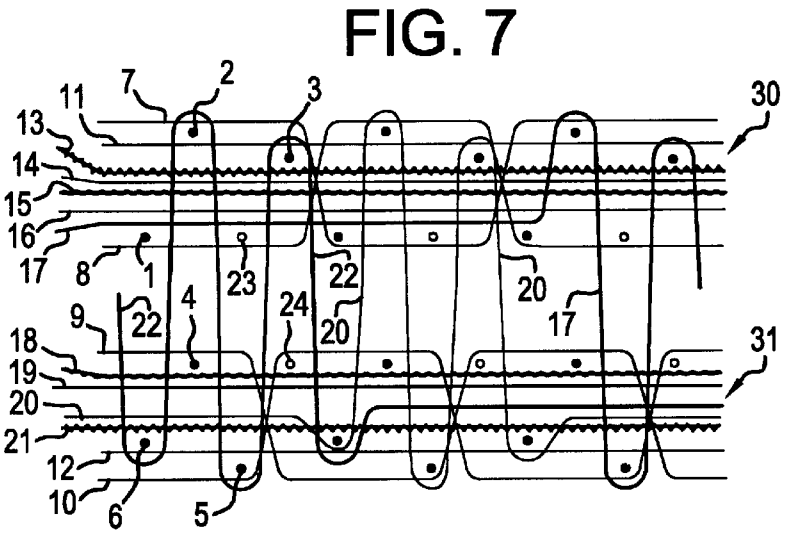
FIG. 7
FIG. 8

FACE TO FACE PILE WOVEN FABRICS

BACKGROUND OF THE INVENTION

This invention relates to a method for face-to-face weaving pile fabrics, whereby weft yarns are inserted between binding warp yarns and pile warp yarns so that two backing fabrics are woven one above the other in which groups of three weft yarns are inwoven at different levels in respective openings between binding warp yarns crossing each other, and in which pile warp yarns are alternately interlaced in the top and the bottom backing fabric over a weft yarn in order to form pile according to a two-shot weave.

In order to weave carpets with a high pile density on a weaving machine both the reed pitch (the set-up) of this machine will be set high (e.g. 500 to 512/m) and a high pile row density (e.g. 8 to 10 pile rows per cm) will be implemented. For this purpose the so-called single rapier weaving method will preferably be applied because with this method a pile row can be formed on each weft yarn in the carpet.

When use of the double rapier weaving method is desired then with a two-shot weave twice as many weft yarns as pile rows will have to be inserted and with a three-shot weave three times as many weft yarns as required pile rows. With regard to weft insertion performance it is however desirable to select the double rapier weaving method (whereby in each weft insertion cycle two weft yarns are inserted one above the other), in preference to the single rapier weaving method. Furthermore the pile is held straighter by a two-shot weave because each pile leg is borne by a weft yarn located on the back and is supported on the pile side by an interjacent weft yarn. However when a great number of pile rows per cm is desired this interjacent weft yarn however prevents the pile row density from being increased. Insufficient pick density is obtained in the fabric. Also with the conventional two-shot weave it is determined that at very high densities the inwoven dead pile warp yarns have a tendency to form undesired loops on the back of the fabric. These dead pile warp yarns furthermore also always remain transparent on the back.

In order to solve the above problem with the double rapier weaving method, a method is known from the Belgian patent no. 1 012 005 A3 with the properties that are mentioned in the first paragraph of this specification. According to this method groups of at least three weft yarns are inwoven in the openings between the successive intersections of the binding warp yarns. A pile warp yarn is moreover according to a two-shot weave alternately woven through on a weft yarn that in relation to the tight warp yarns and the inwoven dead pile warp yarns is located along the pile side (hereinafter called "first weft yarn"), and subsequently not woven through on a weft yarn of the same group that in relation to the tight warp yarns and the inwoven dead pile warp yarns is located on the back (hereinafter called "second weft yarn"). The dead pile warp yarns are divided inwoven in the top and the bottom backing fabric, and extend on the pile side of the tight warp yarns between the first mentioned (first) weft yarn and another weft yarn located on the pile side of the tight warp yarns (hereinafter called "third weft yarn"). In this manner the first, second and third weft yarn of each group come to lie in three different planes (at three different levels), through which they are pressed more or less one above the other and enable a great weft density and consequently also a great pile row density. The pattern of the fabric also remains well visible on the back and the inwoven dead pile warp yarns are no longer transparent on the back of the pile fabric. By alternating a through-woven pile tuft with a non-through-woven one the pile warp yarn consumption is furthermore also reduced.

In this manner weaving carpets mechanically with a greater pile density is achieved, for example with a row adjustment of 512/m and a pile row density of 13.5 or 27 weft yarns per cm in the two-shot weave according to FIG. 1 of the above mentioned Belgian patent.

In this patent it is described how such a pile fabric can be woven with four weft yarns per group according to the so-called double rapier weaving method, whereby in each weft insertion cycle two weft yarns are inserted one above the other.

SUMMARY OF THE INVENTION

A purpose of this invention is to find an efficient method according to which such pile fabrics can be woven with three weft yarns per group in a very productive manner.

This purpose is according to this invention achieved by providing a method with the characteristics from the first paragraph of this specification whereby in series of four successive weft insertion cycles in each case three weft yarns are inserted for the top backing fabric and three weft yarns for the bottom backing fabric.

This method makes it possible to implement the face-to-face weaving of a pile fabric whereby the pile is formed very efficiently and with a great productivity according to a two-shot weave. The method is practicable on a weaving machine that is provided for inserting two or more weft yarns per weft insertion cycle, whereby in certain weft insertion cycles less weft yarns are inserted. Moreover weaving can be effected both with and without lancets. Since furthermore only three weft yarns are provided in each opening between binding warp yarns crossing each other pile fabrics with a particularly high pile density can be woven according to this method.

Another object of this invention is a pile fabric manufactured according to this method, in particular a carpet, with a backing fabric in which groups of three weft yarns are inwoven in respective openings between binding warp yarns crossing each other, and in which non-pile-forming pile warp yarns and tight warp yarns are inwoven, and with pile yarns that form pile loops around weft yarns. Through the excellent productivity of the weaving method the production costs of these fabrics can be reduced while very high pile densities are achievable.

This method is preferably so implemented that in each series of four weft insertion cycles there are two cycles in the course of which in each case two weft yarns are inserted, while in the course of the two other cycles in each case only one weft yarn is inserted.

This method has an optimum productivity if it is implemented on a weaving machine that comprises means for inserting at least two weft yarns per weft insertion cycle, while in the course of the cycles in which only one weft yarn is inserted either one weft insertion means is disengaged or no weft yarn is provided to one weft insertion means.

The two weft yarns that are inserted in the course of a same cycle are moreover preferably in each case inwoven respectively in the top and the bottom backing fabric.

In each backing fabric tight warp yarns can be provided and non-pile-forming pile warp yarns are inwoven, and of each group of weft yarns a first and a second weft yarn can be provided respectively along the pile side and along the back of the tight warp yarns and the inwoven pile warp yarns, and a third weft yarn can be provided between on the one hand the tight warp yarns and on the other hand the inwoven pile warp yarns.

Depending on the insertion sequence and inweaving of the weft yarns inserted on their own the method according to this invention can be implemented differently. Thus for example in the course of each series of four successive weft insertion cycles,

- either a third weft yarn for the top backing fabric and a third weft yarn for the bottom backing fabric are single inserted in the course of respective weft insertion cycles;
- or a third weft yarn for the top backing fabric and a second weft yarn for the bottom backing fabric are single inserted in the course of respective weft insertion cycles;
- or a second weft yarn for the top backing fabric and a third weft yarn for the bottom backing fabric are single inserted in the course of respective weft insertion cycles;
- or a third weft yarn for the top backing fabric and a first weft yarn for the bottom backing fabric are single inserted in the course of respective weft insertion cycles;
- or a second weft yarn for the top backing fabric and a first weft yarn for the bottom backing fabric are single inserted in the course of respective weft insertion cycles.

Because of the fact that the three weft yarns of each group are inwoven in a backing fabric at a mutually different level in an opening between crossing binding warp yarns the pile row density can still further be increased.

If furthermore in each backing fabric, the pile-forming pile warp yarns are alternately interlaced over a second and a third weft yarn, the pile warp yarn consumption is reduced. This has the effect of decreasing the production costs.

In the aforesaid Belgian patent BE-1 012 005 it is illustrated in what manner possibly occurring mixed contours can be prevented according to a known method. Mixed contours occur among others in those locations in the fabric where the pile formation of a first pile warp yarn is stopped and is immediately followed by the pile formation of a second pile warp yarn (e.g. in order to make another color visible in the fabric), while the non-pile-forming parts of the first and the second pile warp yarn, respectively before and after this pile change are inwoven in the same backing fabric. The last pile tuft of the first pile warp yarn in the fabric and the first pile tuft of the second pile warp yarn in the fabric are then inwoven between the same two weft yarns, and cause mixed contours. In order to prevent this with the above described two-shot weave it is known that one or both pile warp yarns have to be interlaced over a weft yarn located along the back before allowing them to form pile, respectively be inwoven as dead pile warp yarns. This has the disadvantage that the pattern of the fabric is marred on the back by so-called double points.

Another purpose of this invention is to provide a method with the above mentioned characteristics, according to which a pile fabric can be woven in which mixed contours are prevented but of which the pattern is also shown perfectly on the back of the fabric.

This purpose if achieved by a method according to which the last interlacing of a first pile warp yarn that stops forming pile and is inwoven in one of the backing fabrics and the first interlacing of a second pile warp yarn that is inwoven in the aforesaid backing fabric and starts forming pile is implemented over the same weft yarn, while this weft yarn extends along the pile side of the fabric in relation to pile warp yarns and/or tight warp yarns inwoven in the backing fabric.

The aforesaid first and second pile warp yarn are interlaced together over a weft yarn that does not extend along the back of the pile fabric, so that these pile warp yarns are not visible on the back and no longer form double points that mar the appearance of this back.

These and other characteristics and distinctive features of this invention are described in the following more detailed specification of a possible method according to this invention and of a carpet woven according to this method. This specification only has the purpose of explaining the invention on the basis of an example and may therefore in no way be considered as a restriction on the scope of this patent application.

In this specification reference is made to the FIGS. 1 through, 18 attached hereto, of which.

BRIEF DESCRIPTION OF THE DRAWINGS

FIGS. 1, 3, 5, 7, 9, 11, 13, 15 and 17 represent a schematic cross-section in warp direction of a part of a carpet that is woven according to respective different methods according to this invention, while in these figures in each case the locations are represented (by unfilled small circles) where a weft yarn is omitted by weft disengagement or weft cancellation; and FIGS. 2, 4, 6, 8, 10, 12, 14, 16 and 18 in each case show the same cross-section as the preceding figure represented on the same page, but without indication of the locations where weft yarns have been omitted.

DETAILED DESCRIPTION OF THE PREFERRED EMBODIMENTS

Figure 11:
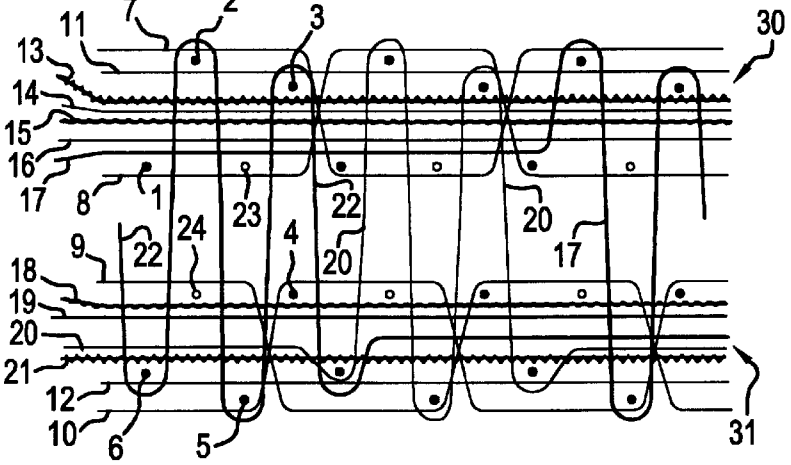

In the figures in each case the warp yarns of one warp yarn system and the weft yarns of a part of a face-to-face pile fabric with high pile density are shown. The face-to-face fabric comprises a top (30) and a bottom fabric (31) and pile warp yarns alternately interlaced in the top and the bottom backing fabric. Dead pile warp yarns are divided between the two backing fabrics. The figures clearly show which positions the various warp yarns of the system occupy in relation to the successive weft yarns (1–6).

Each warp yarn system comprises two binding warp yarns (7), (8) and one tight warp yarn (11) for the top backing fabric (30), two binding warp yarns (9), (10) and one tight warp yarn (12) for the bottom backing fabric (31), and ten pile warp yarns (13)–(22).

The methods are implemented on a face-to-face weaving machine of the double rapier type that is therefore provided for inserting in each case two weft yarns one above the other in the course of the successive weft insertion cycles. In the figures the weft yarns that are inserted in the course of the same weft insertion cycle are represented vertically one above the other.

In the course of a number of cycles one of the two rapier mechanisms is disengaged or one of the rapiers is not threaded with a weft yarn in the course of its insertion movement so that in that cycle only one weft yarn is inserted. The locations where in the course of that cycle normally a second weft yarn would indeed have been inserted, are indicated in the figures with uneven figure numbers by an unfilled small circle (23), (24).

In FIGS. 1 and 2 a first method is illustrated according to which in successive series of four successive weft insertion cycles in each case three weft yarns (1), (2), (3) are inserted for the top backing fabric (30) and three weft yarns (4), (5), (6) for the bottom backing fabric (31).

In the course of the first and the second cycle of each series two weft yarns (1), (5); (2), (4) are inserted one above the other. In the course of the third insertion cycle a weft yarn (6) is inserted only by the bottom rapier while the top rapier is disengaged or is not provided with a weft yarn, so that in the location indicated by the reference number 23 no weft yarn is inserted. In the course of the fourth weft insertion cycle a weft yarn (3) is inserted only by the top rapier while the bottom rapier is disengaged or is not provided with a weft yarn, so that in the location indicated by the reference number 24 no weft yarn is inserted.

The binding warp yarns (7), (8) for the top backing fabric (30) run alternately above and below a group of three weft yarns (1–3). If one binding warp yarn (7) extends above the weft yarns (1–3), the other weft yarn (8) is below these weft yarns (1–3). In each case after the fourth weft insertion cycle the two binding yarns (7), (8) cross each other.

The binding warp yarns (9), (10) for the bottom backing fabric (31) run in the same manner alternately above and below a group of three weft yarns (4–6), and cross each other in each case after the fourth weft insertion cycle.

The top weft yarn (1) that is inserted in the course of the first insertion cycle, is inwoven in the top backing fabric (30) along the pile side of the tight warp yarn (11) and the dead pile warp yarns (13–17) inwoven in this backing fabric (30). The bottom weft yarn (5) that is inserted in the course of that first cycle, is inwoven in the bottom backing fabric (31) along the back of the tight warp yarn (12) and the dead pile warp yarns (18–22) in this backing fabric (31).

Of the weft yarns (2), (4) inserted in the course of the second insertion cycle the top weft yarn (2) is inwoven in the top backing fabric (30) along the back of the tight warp yarn (11) and the inwoven dead pile warp yarns (13–17), and the bottom weft yarn (4) is inwoven in the bottom backing fabric (31) along the pile side of the tight warp yarn (12) and the inwoven dead pile warp yarns (18–22).

The weft yarn (6) inserted in the course of the third insertion cycle is inwoven in the bottom backing fabric (31) between the inwoven dead pile warp yarns (18–22) and the tight warp yarn (12) running along the back thereof.

The weft yarn (3) inserted in the course of the fourth insertion cycle is inwoven in the top backing fabric (30) between the inwoven dead pile warp yarns (13–17) and the pile warp yarn (11) running along the back thereof.

A weft yarn (1), (4) that is inwoven along the pile side of the tight warp yarn (11), (12) and the inwoven dead pile warp yarns (13–17), (18–22) is called a "first weft yarn" in this patent application. A weft yarn (2), (5) that is inwoven along the back of the tight warp yarn (11), (12) and the inwoven dead pile warp yarns (13–17); (18–22) is called a "second weft yarn" in this patent application.

A weft yarn (3), (6) that is inwoven between the tight warp yarn (11), (12) and the inwoven dead pile warp yarns (13–17), (18–22) is called a "third weft yarn" in this patent application.

The pile-forming pile warp yarns (22), (20) (17) are alternately interlaced over a weft yarn of the top backing fabric (30) and over a weft yarn of the bottom backing fabric (31). In each fabric (30), (31) a pile-forming tight warp yarn is alternately interlaced over a second (2), (5) and a third weft yarn (3), (6).

In the top backing fabric (30) in the course of each series of four weft insertion cycles a first weft yarn (1), a second weft yarn (2), no weft yarn and a third weft yarn is successively provided.

In the bottom backing fabric (31) in the course of each series of four weft insertion cycles a second weft yarn (5), a first weft yarn (4), a third weft yarn (6) and no weft yarn is successively provided.

In each opening between two intersections of the binding warp yarns (7), (8) in the top backing fabric a first (1), a second (2) and a third weft yarn (3) are therefore successively inwoven. In the bottom backing fabric (31) that is successively a second (5), a first (4) and a third weft yarn (6).

In each warp yarn system ten pile warp yarns (13–22) with a different color are provided. In each warp yarn system different pile warp yarns can successively be allowed to form pile, in order to obtain a color variation in warp direction. A color variation can also be obtained in weft direction by using different pile warp yarns, located next to one another in warp yarn systems, for the pile formation. These color variations can be so implemented that a pattern, a design or a figure is made visible in the pile fabric.

When a pile-forming pile warp yarn stops forming pile and is immediately followed by another pile-forming pile warp yarn it is called a pile change.

In the fabric from FIGS. 1 and 2 a pile change is implemented with the fifth weft insertion cycle and with the tenth weft insertion cycle.

The method illustrated in FIGS. 3 and 4 only differs from the method according to FIGS. 1 and 2 because of the fact that now in the course of the first weft insertion cycle (instead of the third cycle) in the top backing fabric (30) no weft yarn is inserted (in the location indicated by reference number 23).

The method illustrated in FIGS. 5 and 6 only differs from the method according to FIGS. 1 and 2 because of the fact that now in the course of the second weft insertion cycle (instead of the fourth cycle) no weft yarn is inserted in the bottom backing fabric (31) (in the location indicated by reference number 24).

The face-to-face fabric from FIGS. 7 and 8 illustrates a method that differs from the method according to FIGS. 1 and 2 through a different pile warp yarn path with the pile change that takes place with the fifth weft insertion cycle, because of the fact that the weft yarn (6) that is inserted in the course of the first insertion cycle by the bottom rapier is now inwoven in the bottom backing fabric (31) as third weft yarn, and because of the fact that the weft yarn (5) that in the course of the third cycle is inserted by the bottom rapier is now inwoven as second weft yarn in the bottom backing fabric (31).

The pile change with the fifth weft insertion cycle is implemented as follows:

the pile warp yarn (22) that stops forming pile and after the pile change is inwoven in the bottom backing fabric (31), is interlaced for a last time over a third weft yarn (6) in the bottom backing fabric (31).

The pile warp yarn (20) that starts forming pile and prior to the pile change is inwoven in the bottom backing fabric (31), is interlaced for A first time over the same third weft yarn (6).

Since this third weft yarn (6) lies along the pile side in relation to the tight warp yarns (12) the pile warp yarns (22), (20) interlaced together over this weft yarn (6) are not visible along the fabric back so that no annoying double point is formed.

Through this pile change it is furthermore also achieved that the neighboring pile tufts of the various pile warp yarns (22), (20) stand upright so that a clear dividing line can be seen between the color areas formed by these pile warp yarns, in other words that mixed contours are prevented.

With the second pile change (with the tenth insertion cycle) the successive pile-forming pile warp yarns are inwoven in the different backing fabrics (30), (31) so that no measures need to be taken in order to avoid mixed contours.

Figure 9:
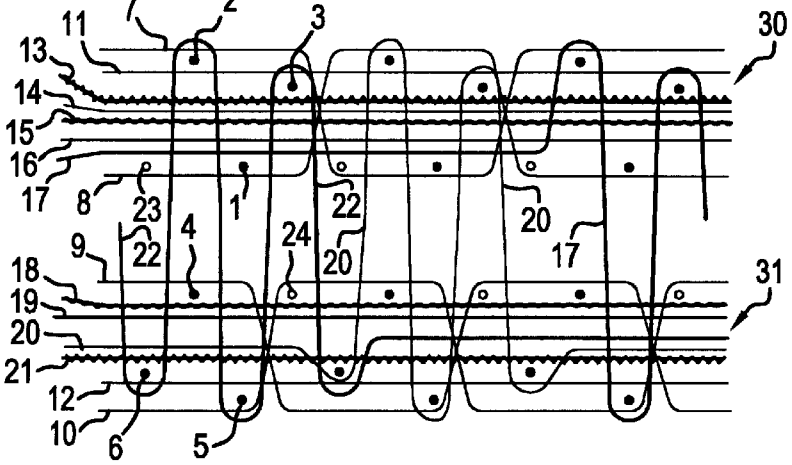
Figure 10:
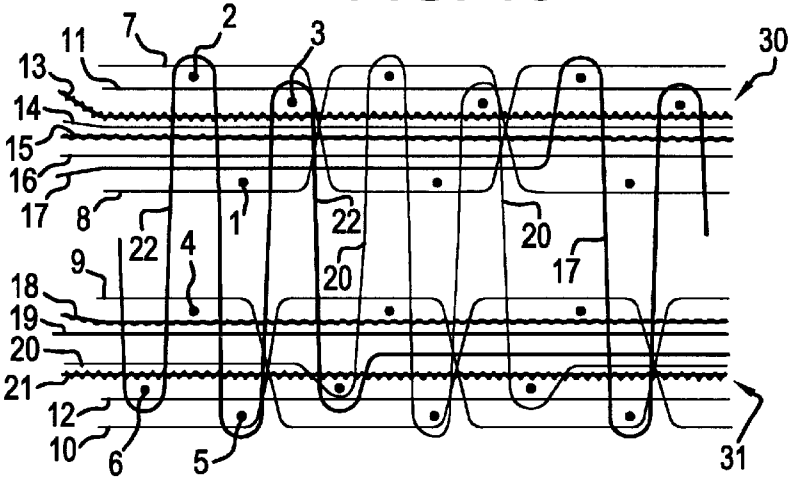

With the method according to FIGS. 9 and 10 the first pile change (with the fifth cycle) is performed in the same manner. This method only differs from the one according to FIGS. 7 and 8 because of the fact that now in the course of the first weft insertion cycle (instead of the third cycle) no weft yarn is inserted (by the top rapier) in the top backing fabric (30).

Figure 12:
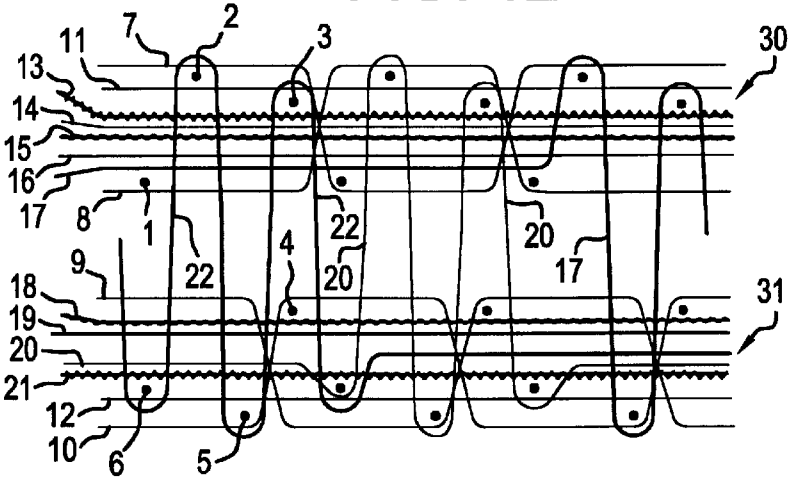

The method illustrated in FIGS. 11 and 12 only differs from the method according to FIGS. 7 and 8 because of the fact that now in the course of the second weft insertion cycle (instead of the fourth cycle) no weft yarn is inserted (by the bottom rapier) in the bottom backing fabric (31).

Figure 13:
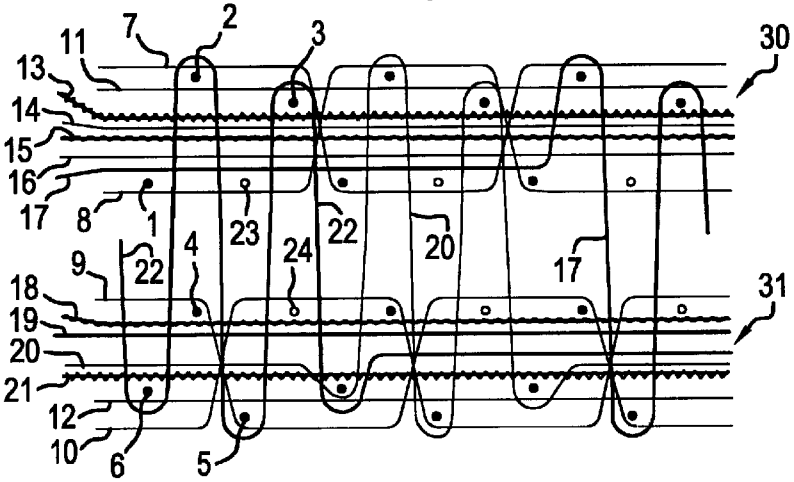
Figure 14:
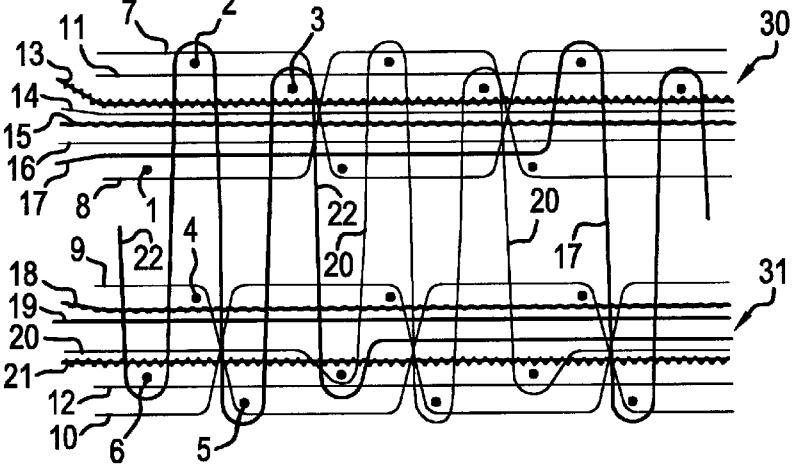

The method illustrated in FIGS. 13 and 14 differs from the method according to FIGS. 7 and 8 because of the fact that the binding warp yarns (9), (10) of the bottom backing fabric (31) are allowed to cross after the second weft insertion cycle (instead of the third cycle). The top fabric (30) therefore remains identical to that from FIGS. 7 and 8, but the bottom backing fabric (31) now differs because of the fact that per opening between the binding warp yarns (9), (10) in the course of the successive insertion cycles a second weft yarn (5), no weft yarn, a third (6) and a first weft yarn (4) are provided (there where that according to FIGS. 7 and 8 successively no weft yarn, a third (6), a first (4) and a second weft yarn (5) was).

Figure 15:
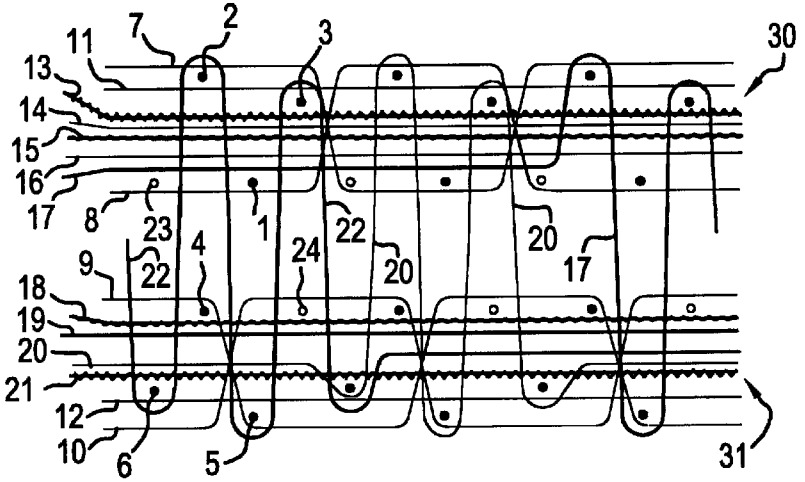
Figure 16:
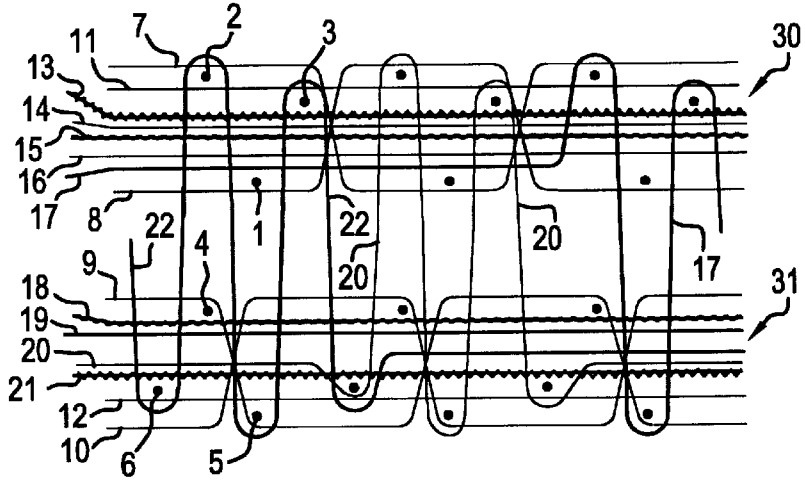

The face-to-face fabrics shown in FIGS. 15 and 16 are the result of a method that only differs from the method according to FIGS. 13 and 14 because of the fact that now in the course of the first weft insertion cycle (and not the third cycle) no weft yarn is inserted in the top backing fabric (30).

Figure 17:
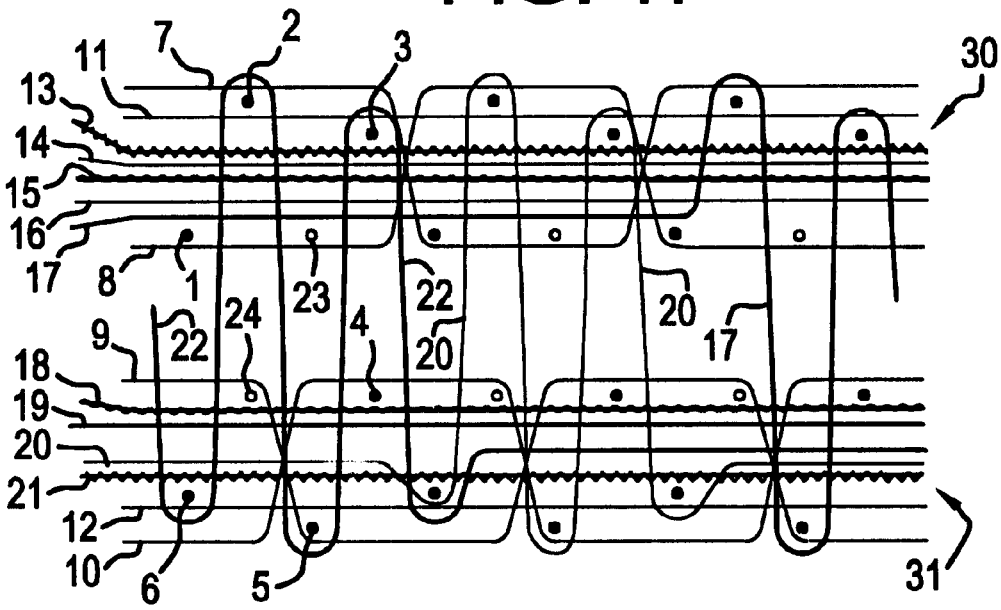
Figure 18:
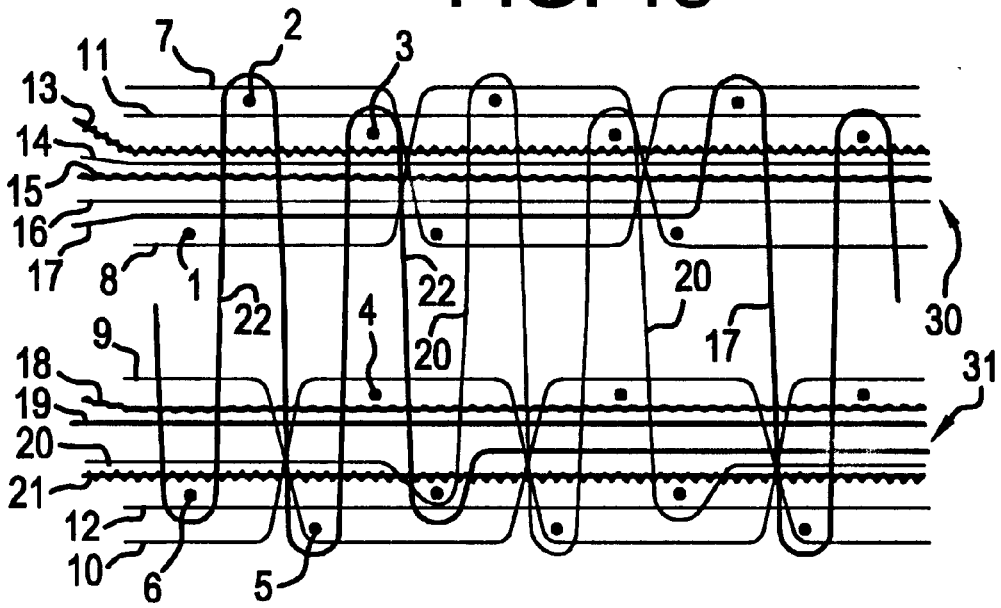

The fabrics shown in FIGS. 17 and 18 are the result of a method that varies from the method that produces the fabrics according to FIGS. 13 and 14 because of the fact that now in the course of the second weft insertion cycle (and not the fourth cycle) no weft yarn is inserted in the bottom backing fabric (31).

The various methods have the advantage that they enable pile fabrics to be woven, whereby according to a two-shot weave pile is formed on a double rapier weaving machine, while nevertheless in each backing fabric (30), (31) only three weft yarns (1–3), (4–6) are provided between successive intersections between the binding warp yarns (7), (8); (9), (10).

Per group of weft yarns (1–3), (4–6) there is in other words only one weft yarn over which no pile loop is formed. Because of this the pile row density can be considerably higher than in the case where four weft yarns are provided per group.

What is claimed is:

1. A method for weaving face-to-face pile fabrics comprising inserting weft yarns (1), (2), (3), (4), (5), (6) between binding warp yarns (7), (8), (9) (10) and pile warp yarns (13)–(22), weaving two backing fabrics (30), (31) one above another into a top backing fabric and a bottom backing fabric, inweaving groups of three weft yarns (1–3); (4–6) in respective openings between the binding warp yarns (7), (8), (9) (10) crossing each other, and alternately interlacing the pile warp yarns in the top (30) and the bottom backing fabrics (31) over a weft yarn (1–3), (4–6), forming pile according to a two-shot weave, and inserting in series of four successive weft insertion cycles in each cycle three weft yarns (1), (2), (3) for the top backing fabric (30) and three weft yarns (4), (5), (6) for the bottom backing fabric (31).

2. The method of claim 1, wherein the inserting in series comprises inserting two weft yarns in two cycles of each series of four weft insertion cycles, and inserting one weft yarn in two other cycles in each series of four weft insertion cycles.

3. The method of claim 2, further comprising providing a weaving machine having weft insertion means, wherein the weaving comprises weaving on the weaving machine having the weft insertion means for inserting at least two weft yarns (1–6) per weft insertion cycle, and in cycles comprising one weft yarn insertion disengaging one weft insertion means for inserting the one weft yarn or not providing the one weft yarn to the one weft insertion means.

4. The method of claim 1, wherein inserting the two weft yarns in a same cycle comprises inweaving in each case respectively in the top (30) and the bottom backing fabrics (31).

5. The method of claim 1, further comprising providing tight warp yarns (11), (12) in each backing fabric (30), (31) and inweaving non-pile-forming pile warp yarns (13–22), and providing a first (1), (4) and a second weft yarn (2), (5) from each group of weft yarns (1–3), (4–6), respectively, along a pile side and along a back of the tight warp yarns (11), (12) and the inwoven pile warp yarns, and providing a third weft yarn (3), (6) between the tight warp yarns (11), (12) and the inwoven pile warp yarns (13–17), (18–22).

6. The method of claim 5, wherein the providing comprises inserting singly in each series of weft insertion cycles a third weft yarn (3) for the top backing fabric (30) and a third weft yarn (6) for the bottom backing fabric (31) during respective weft insertion cycles.

7. The method of claim 5, wherein the providing comprises inserting singly in each series of weft insertion cycles a third weft yarn (3) for the top backing fabric (30) and a second weft yarn (5) for the bottom backing fabric (31) during respective weft insertion cycles.

8. The method of claim 5, wherein the providing comprises inserting singly in each series of weft insertion cycles a second weft yarn (2) for the top backing fabric (30) and a third weft yarn (6) for the bottom backing fabric (31) during respective weft insertion cycles.

9. The method of claim 5, wherein the providing comprises inserting singly in each series of weft insertion cycles a third weft yarn (3) for the top backing fabric (30) and a first weft yarn (4) for the bottom backing fabric (31) during respective weft insertion cycles.

10. The method od claim 5, wherein the providing comprises inserting singly in each series of weft insertion cycles a second weft yarn (2) for the top backing fabric (30) and a first weft yarn (4) for the bottom backing fabric (31) during respective weft insertion cycles.

11. The method of claim 1, wherein the inserting the weft yarns comprises inweaving the three weft yarns (1–3), (4–6) of each group in each backing fabric (30), (31) at a mutually different level in an opening between crossing binding warp yarns (7, 8), (9, 10).

12. The method of claim 1, further comprising in each backing fabric (30), (31), alternately interlacing the pile-forming pile warp yarns over a second (2), (5) and a third weft yarn (3), (6).

13. The method of claim 1, further comprising implementing over a same weft yarn (3), (6), a last interlacing of a first pile warp yarn (22) that stops forming pile and is inwoven in one of the backing fabrics (31) and a first interlacing of a second pile warp yarn (20) inwoven in the one of the backing fabrics (31) that starts forming pile, and extending the same weft yarn (3), (6) along the pile side of the fabric in relation to pile warp yarns (18–22) and/or tight warp yarns (12) inwoven in the backing fabric (31).

14. The method of claim 13, further comprising inweaving the same weft yarn on which the first and last interlacing is implemented in the backing fabric (31) between tight warp yarns (12) and inwoven pile warp yarns (18–22).

15. A pile fabric woven according to the method of claim 1.

16. A pile fabric with a backing fabric comprising non-pile-forming pile warp yarns (13–17), (18–22) inwoven with tight warp yarns (11), (12), and pile yarns (22), (20), (17) forming pile loops around weft yarns (1)–(16), the backing fabric comprising a top and a bottom backing fabric having groups of three weft yarns (1–3); (4–6) inwoven in respective openings between binding warp yarns (7), (8), (9) (10) crossing each other, and alternately interlaced pile warp yarns in the top (30) and the bottom backing fabrics (31) over a weft yarn (1–3), (4–6), forming pile according to a two-shot weave, and in series of four successive weft insertion cycles in each case including the three weft yarns (1), (2), (3) for the top backing fabric (30) and the three weft yarns (4), (5), (6) for the bottom backing fabric (31), wherein each fabric comprises three weft yarns forming four pile legs for increasing pile row density in the fabrics.

* * * * *